US005527075A

United States Patent [19]

Jones et al.

[11] Patent Number: 5,527,075

[45] Date of Patent: Jun. 18, 1996

[54] PORTABLE GOLF BALL RETRIEVER

[76] Inventors: Lee R. Jones, 3030 Walnut Ave., Winston-Salem, N.C. 27106; Charles R. Jones, Jr., 1183 Pullman Dr., Rural Hall, N.C. 27045; Charles R. Jones, Sr., 3030 Briarcliffe Rd., Winston-Salem, N.C. 27106

[21] Appl. No.: 334,041

[22] Filed: Nov. 4, 1994

[51] Int. Cl.[6] ..... A63B 47/02

[52] U.S. Cl. ..... 294/19.2

[58] Field of Search ..... 273/32 F; 294/19.2

[56] References Cited

U.S. PATENT DOCUMENTS 4,318,654 3/1982 Lee ..... 294/19.2

4,991,896 2/1991 Martin ..... 294/19.2

*Primary Examiner*—William H. Grieb

[57] ABSTRACT

A portable golf ball retriever utilizing a knock down handle and a yoke formed from horizontal and depending side support members, the side members supporting an axle extending therethrough. A plurality of discs are rotatably affixed to the axle and fingers extend between the discs and the adjacent side support members to dislodge balls collected between the discs as the retriever is exposed thereto. A ball collecting device is releasably secured to the handle and yoke of a size to accommodate the handle, yoke, axle and plurality of discs and function as a carrying bag therefor. Handles are affixed to the collecting device to make it convenient to carry the container from place to place.

3 Claims, 2 Drawing Sheets

PORTABLE GOLF BALL RETRIEVER

BACKGROUND OF THE INVENTION

1. Field of the Invention

The present invention relates to portable golf ball retrievers and more particularly to golf ball retrievers having a knock down handle and a dual functioning ball collector and carrying case.

2. Description of the Prior Art

Golfers have a constant need to practice their game and by doing so hit thousands of practice balls from one location to another. Collecting the hit balls in a convenient container and repositioning them for additional practice is normally a time consuming activity. Most golf ball retrievers involved in this activity operate by encapsulating a single ball at a time until a predetermined number is collected within an attached receptacle.

In other situations, golfers often times lose balls in a water hazard such as a lake or stream. Golf ball retrievers utilizing extendable handles with cups or other devices to retrieve balls singularly have, for the most part, been used in this situation. Generally, these devices are effective only to retrieve visually noted balls and are relatively ineffective in retrieving balls not visible to the eye.

Larger devices utilizing a plurality of discs have been used for collecting a plurality of balls from driving ranges and the like wherein a tractor pulls the device over a large surface area and collects the engaged balls in a collecting trough. These known devices are relatively large and heavy and are not practical for use by the individual golfer in a playing situation or in an individual practice session.

Thus there exists a need for such a convenient and portable device and it is to this need that the present invention is directed.

OBJECTIVES AND SUMMARY OF THE INVENTION

It is a primary objective of this invention to provide a golf ball retrieving device constructed in a manner wherein it is readily portable and may be easily carried with a golfer to a practice session or to retrieve lost balls in lakes or other inaccessible locations.

Another objective of the present invention is to provide a retrieval device of the type described which utilizes a ball collecting element that is also usable as a carrying case.

A still further objective of the present invention is to provide a golf ball retriever of the type described which is simple and economical in construction but which can function to retrieve balls from accessible greens and fairways as well as normally inaccessible areas such as lakes and streams.

The device comprising the present invention in its simplest form includes a knock down handle, a yoke having horizontal and depending side support members, an axle supported by the side support members, and a plurality of discs rotatably affixed to the axle. Appropriate finger means are provided that extend between the discs and the disc and side support members to dislodge the balls collected between the discs as they are engaged. A ball collecting device which can be a basket or bag is provided with releasably securable elements to attach it to the handle and yoke. The ball carrying device is of a size sufficient to conform to a compact and space-conscious carrying container for a handle, axle, yoke and discs.

Thus there has been outlined the more important features of the invention in order that the detailed description thereof that follows may be better understood and in order that the present contribution to the art may be better appreciated. There are, of course, additional features of the invention that will be described hereinafter and which will form the subject matter of the claims appended hereto. In this respect, before explaining one or more embodiments of the invention in detail, it is to be understood that the invention is not limited in its application to the details of construction and to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting in any respect. As such, those skilled in the art will appreciate the concept upon which this disclosure is based and that it may readily be utilized as a basis for designing other structures, methods and systems for carrying out the several purposes of the invention. It is important that the claims be regarded as including such equivalent constructions insofar as they do not depart from the spirit and scope of the present invention.

Thus the objectives set forth above, together with other objectives of the invention, along with the various features of novelty which characterize the invention, will become more apparent after consideration of the following detailed description of the invention taken in conjunction with the accompanying drawings in which like characters of reference designate like parts throughout the several views.

DESCRIPTION OF THE PREFERRED EMBODIMENTS

Figure 1:
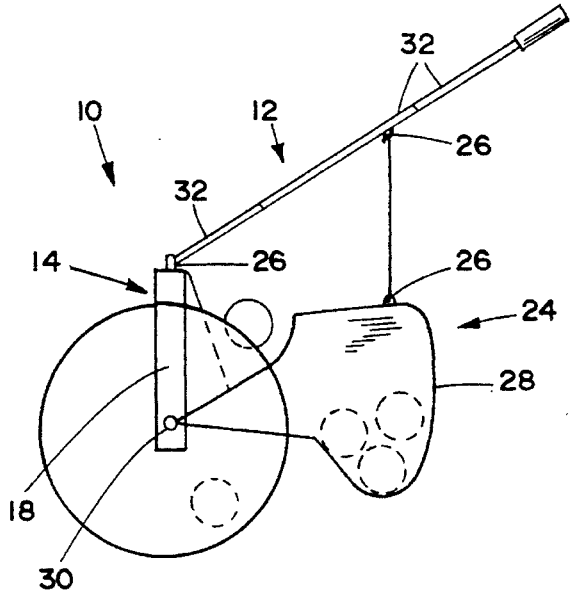
FIG. 1 is a side elevational and schematic view of the golf ball retriever comprising the present inventive concept showing the ball collecting means as a bag.
Figure 2:
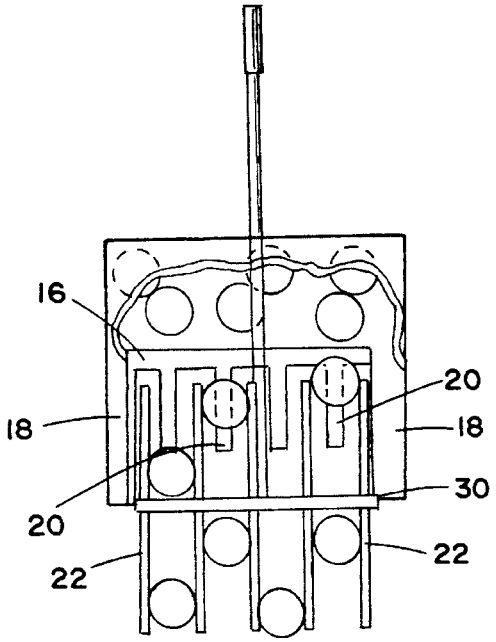
FIG. 2 is a front elevational view of the portable ball retriever of FIG. 1.
Figure 3:
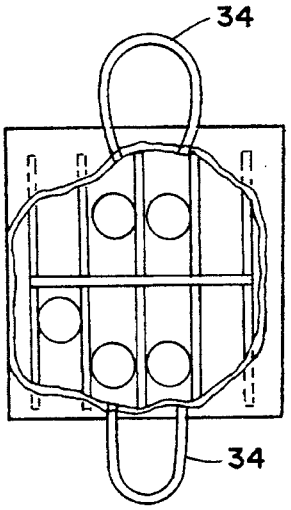
FIG. 3 is a plan view of the portable golf ball retriever disassembled and carried by the ball collecting device.
Figure 4:
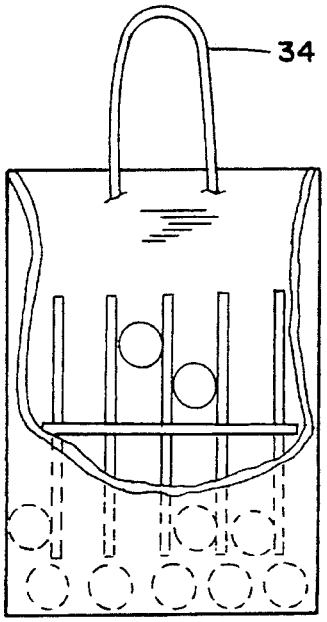
FIG. 4 is a side elevational view of the carry device shown in FIG. 3.
Figure 5:
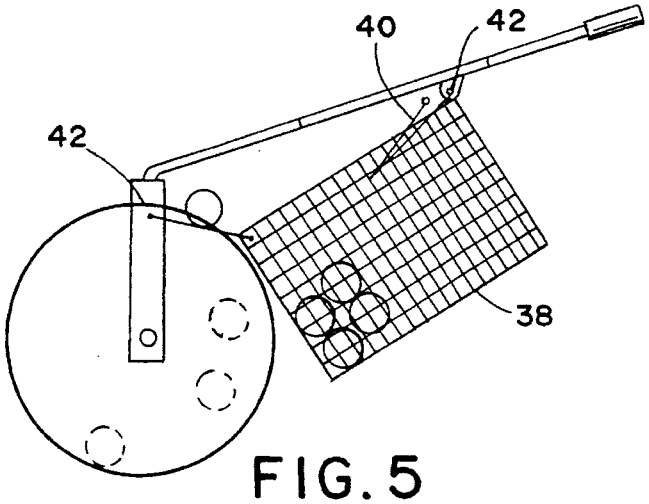
FIG. 5 is a side elevational view of another embodiment of the portable golf ball retriever in which the ball collecting device is a basket.
Figure 6:
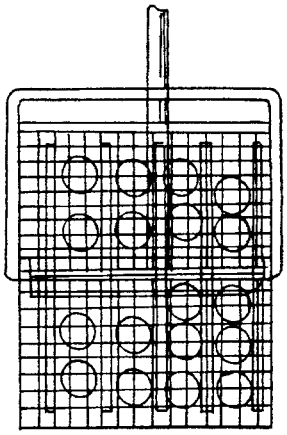
FIG. 6 is a plan view of the device shown in FIG. 5.
Figure 7:
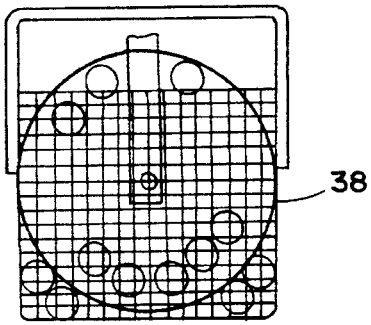
FIG. 7 is a side elevational view of the device shown in FIGS. 5 and 6.
Figure 8:
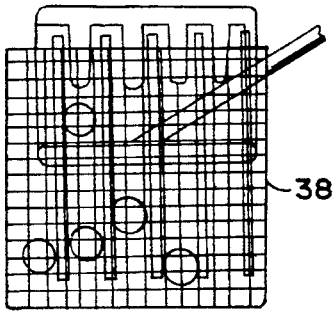
FIG. 8 is a front elevational view of the device shown in FIG. 7.

Refer now to the drawings and particularly to FIG. 1, a portable ball retriever shown generally as 10 includes a knock down handle 12 and a yoke 14 having a horizontal support member 16 and depending side support members 18. Ball expelling fingers 20 are positioned between a plurality of discs 22 and optionally between the outermost discs 22 and depending side support members 18. A ball collecting device shown generally as 24 is releasably secured to handle 12 and yoke 14 by grasping means such as a plurality of snaps 26 or other equally appropriate devices. The ball carrying device 24, in this instance a bag 28, is formed of a size sufficient to provide a carrying container for handle 12, yoke 14, discs 22 and axle 30.

Handle 12 is formed of a plurality of releasably securable segments 32, and finger elements 20 are positioned at least partially between adjacent discs 22 and optionally between the outwardly positioned discs 22 and the side support members 18.

Grasping means for carrying the ball collecting device 28 may be a pair of handles 34 or other equally appropriate elements.

An alternative embodiment of the present invention is shown in FIGS. 5 through 8 and essentially comprises the use of a rectangularly shaped basket 38 which is equipped with foldable handles 40 to accommodate the user. Again, basket 38 is affixed to handle 12 and yoke 14 by appropriate snaps 42.

All embodiments of the present invention include a plurality of discs 22 that are spaced from each other a sufficient distance to snugly engage a retrieved golf ball and hold it therein for disposition by engagement with fingers 20. The disengaged balls are collected by either bag 28 or basket 38 for subsequent use as desired.

Obviously the golf ball retriever comprising the present invention may be used to collect an accumulation of balls on a green or fairway during practice or from a normally inaccessible area such as a lake or stream bottom.

The preceding description of two preferred embodiments of the present invention is intended illustrative of two preferred forms of the invention. It is anticipated that the discs and axle may be molded or fabricated from plastic. Other modifications and enhancements of the present invention will be apparent based upon the above description. The scope of the present invention should be measured by the following claims and not be limited by the above description of the preferred embodiments.

With respect to the foregoing description, it is to be realized that the optimum dimensional relationship of the parts of the invention, to include variations in size, materials, shape, form, function and manner of operation, assembly and use, are deemed readily apparent and obvious to one skilled in the art and all equivalent relationships to those illustrated in the drawings and described in the specification are intended to be encompassed herein.

What is claimed is:

1. A portable golf ball retriever comprising a knock-down handle; a yoke having a horizontal support member and depending side support members releasably secured to the handle; an axle supported by the depending side support members; a plurality of discs rotatably affixed to the axle; means extending between the discs and the side support members; ball collecting means releasably securable to the handle and yoke having grasping means affixed thereto, the ball carrying means having a size sufficient to form a carrying container for the handle, axle, yoke and discs wherein the handle is formed of a plurality of releasably securable segments and wherein the extending means includes a finger element positioned at least partially between each adjacent disc and the adjacent discs and side support members.

2. The retriever as claimed in claim 1 wherein the ball collecting means is a basket, the grasping means is a pair of grasping handles, and the ball collecting means is secured to the handle and yoke by a plurality of snaps.

3. The retriever as claimed in claim 1 wherein the ball collecting means is a bag, the grasping means is a pair of grasping handles, and the ball collecting means is secured to the handle and yoke by a plurality of snaps.

* * * * *